US006320454B1

(12) United States Patent
Pathak et al.

(10) Patent No.: US 6,320,454 B1
(45) Date of Patent: Nov. 20, 2001

(54) LOW POWER VOLTAGE REGULATOR CIRCUIT FOR USE IN AN INTEGRATED CIRCUIT DEVICE

(75) Inventors: Saroj Pathak, Los Altos Hills; James E. Payne, Boulder Creek; Harry H. Kuo, San Jose, all of CA (US)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 09/586,664

(22) Filed: Jun. 1, 2000

(51) Int. Cl.[7] ..... G05F 1/10
(52) U.S. Cl. ..... 327/535
(58) Field of Search ..... 327/74, 75, 403, 327/404, 405, 406, 407, 408, 409, 410, 411, 412, 413, 493, 504, 530, 535, 537, 538, 540, 541, 543, 583

(56) References Cited

U.S. PATENT DOCUMENTS 5,189,316 2/1993 Murakami et al. ..... 307/296.1
5,493,234 2/1996 Oh ..... 326/33
5,592,421 1/1997 Kaneko et al. ..... 365/189.09
5,812,021 9/1998 Ikeda ..... 327/541

*Primary Examiner*—Jeffrey Zweizig
(74) *Attorney, Agent, or Firm*—Thomas Schneck; John P. McGuire, Jr.

(57) ABSTRACT

A voltage regulator circuit that receives an input signal and provides an output signal that is clamped at a specified voltage desired for an internal circuit. The disclosed voltage regulator circuit includes a plurality of subcircuits including a voltage tracking subcircuit in which the output voltage tracks the input voltage with no voltage drop when the input voltage starts to rise from zero volts. If the input voltage increases to a desired voltage level for the internal circuit, the voltage tracking subcircuit clamps the output voltage to remain at that voltage. If the input voltage further increases to a higher voltage, the voltage tracking subcircuit is disabled and one of a plurality of voltage maintaining subcircuit takes control so that the output voltage remains at the desired voltage for the internal circuit.

28 Claims, 5 Drawing Sheets

LOW POWER VOLTAGE REGULATOR CIRCUIT FOR USE IN AN INTEGRATED CIRCUIT DEVICE

TECHNICAL FIELD

The invention relates to voltage regulator circuits, and more particularly to a circuit that receives an external power supply voltage as an input and provides as an output a specified level of voltage for an internal circuit of an integrated circuit device.

BACKGROUND ART

In the field of integrated circuits, compatibility requires the use of a conventional 5V power supply for most circuit devices. Also, compatibility requires many TTL circuits to work at a conventional 5V external power supply voltage. However, when the degree of integration increases, many circuits are manufactured to work at a lower voltage (such as 3V) in order to lower power consumption and reduce excessive electrical field. Therefore, there is a need for voltage regulator circuits (voltage stepdown circuits) arranged inside the devices to convert the high voltage level (5V) of an external power supply down to a desired level (3V–4V) and to supply that voltage to the internal circuit of the device. Many designs of the voltage regulator circuit exist.

FIG. 7 shows a conventional internal stepdown circuit 17 that is also described in the background art section of U.S. Pat. No. 5,189,316 to Murakami et al. The illustrated internal stepdown circuit 17 essentially consists of a reference voltage generator circuit 100 and an internal voltage control circuit 200. The reference voltage generator circuit 100 is adapted to generate a reference voltage VREF with respect to the internal voltage control circuit 200, and includes p-channel MOS (PMOS) transistors 111–115. The PMOS transistors 111–113 are connected in series to each other and are interposed between a supply input terminal 300 and ground GND. These PMOS transistors 111–113 are used as resistors, respectively, and constitute a resistive potential divider circuit. The supply input terminal 300 receives a supply voltage Ext.Vcc from an external power supply (not shown). Other PMOS transistors 114 and 115 are connected in series to each other, and are interposed between the supply input terminal 300 and the ground GND in parallel to the above described PMOS transistors 111–113.

The internal voltage control circuit 200 is adapted to correct an internal voltage VINT based on the reference voltage VREF so as to prevent the fluctuation of the internal voltage VINT which may be caused by the fluctuation of the supply voltage Ext.Vcc, and is formed of a current quantity switching circuit 210, a voltage comparator circuit 220 and an output transistor P225. The current quantity switching circuit 210 is adapted to switch a current quantity supplied to the voltage comparator circuit 220 in accordance with switching between an active mode and a standby mode of the semiconductor integrated circuit device, and is formed of two PMOS transistors P211 and P212 interposed in parallel between the supply input terminal 300 and the voltage comparator circuit 220. The voltage comparator circuit 220 is adapted to make a comparison between the reference voltage VREF applied from the reference voltage generator circuit 100 and the internal voltage VINT supplied from the output transistor P225 and to control a conductivity of the output transistor P225 in accordance with a result of the comparison. The voltage comparator circuit 220 is formed of two PMOS transistors P223 and P224 and two N-channel MOS (NMOS) transistors N221 and N222.

The reference voltage generator circuit 100 generates a constant reference voltage, VREF, which is supplied to the voltage comparator circuit 220. When the semiconductor integrated circuit device provided with the internal stepdown circuit 17 shown in FIG. 7 is in an active mode, the clock signal CS supplied to the current quantity switching circuit 210 is at a low level (logic level=0). Therefore, the PMOS transistor P211 is kept on in the active mode. Meanwhile, the PMOS transistor P212 is always in the on state because its gate is connected to the ground GND. Therefore, both the PMOS transistors P211 and P212 are turned on in the active mode, and thus a large current is supplied to the voltage comparator circuit 220. The voltage comparator circuit 220 compares the reference voltage VREF with the internal voltage VINT. When the voltage VREF becomes smaller than the voltage VINT, for instance, due to the increase of the internal voltage VINT caused by the increase of the supply voltage Ext.Vcc or other reasons, the conductivity of the PMOS transistor P224 decreases. Correspondingly, the potential at the drain of the PMOS transistor P224 decreases, and thus the conductivity of the NMOS transistor N221 decreases. Consequently, the potential at the drain of the NMOS transistor N221 increases, resulting in reduction of the conductivity of the output transistor P225. Accordingly, the internal voltage VINT decreases to the same value as the voltage VREF (VINT=VREF). Conversely, if the internal voltage VINT decreases to a value less than the reference voltage VREF (VREF>VINT) the circuit 17 operates in a manner opposite to that described above to maintain the internal voltage VINT at the reference voltage VREF.

As described above, the internal stepdown circuit of FIG. 7 generates the internal voltage VINT independent of the supply voltage Ext.Vcc. This internal voltage VINT is applied to respective internal circuits in the semiconductor integrated circuit device.

When the semiconductor integrated circuit device provided with the internal stepdown circuit 17 of FIG. 7 is in a standby condition, the clock signal CS is at the "H" level and the PMOS transistor P211 is maintained in an off state. Consequently, the current quantity supplied from the current quantity switching circuit 210 to the voltage comparator circuit 220 is reduced, resulting in reduction of the consumption power in the standby mode.

As described above, the internal stepdown circuit of the prior art shown in FIG. 7 is intended to reduce the consumption power in the standby mode by setting the PMOS transistor P211 at the off state in the standby mode. However, even when the PMOS transistor P211 is turned off, a current is supplied to the voltage comparator circuit 220 in the standby mode through the PMOS transistor P212, because this PMOS transistor P212 is turned on. Further, the internal stepdown circuit of the prior art shown in FIG. 7 has structures in which the current flows in the reference voltage generator circuit 100 even in the standby mode.

Other prior art inventions try to reduce power consumption of the reference voltage generator circuit 100 and the internal voltage control circuit 200 by placing transistors as switches in series with these circuits in order to turn them off during standby mode. However, this does not significantly reduce the power consumption of the circuits because during active mode these circuits still consume power.

Therefore, the internal stepdown circuits of the prior art, such as the circuit shown in FIG. 7, still have a serious problem in that the consumption power cannot be sufficiently reduced. Many prior art circuits burn approximately 1 mA or greater of the supply current. Moreover, the circuits are rather complicated and many prior art circuits require the use of a operational amplifiers and band gap references, making the circuits large and power consuming.

An object of the present invention is to provide a circuit that has low power consumption and which burns approximately 0.5 $\mu$A of the supply current, which is much lower than in the prior art.

Another object of the present invention is to provide a simple voltage regulator circuit that occupies a small area and does not require the use of an operational amplifier.

SUMMARY OF THE INVENTION

The above objects have been achieved in the present invention, which provides a voltage regulator circuit that can be described as being made up of a voltage monitoring subcircuit, a voltage tracking subcircuit and a plurality of voltage maintaining subcircuits with an input and an output. The voltage tracking subcircuit functions to have the output voltage track the input voltage when the input voltage increases from zero volts. The voltage maintaining subcircuits function to clamp the output voltage at the desired voltage for an internal circuit whether the input voltage remains at that desired voltage or continues to rise to a higher voltage. The voltage monitoring subcircuit functions to disable the voltage tracking subcircuit when the input voltage continues to rise above the desired voltage for the internal circuit and to enable the appropriate ones of the voltage maintaining subcircuits to control the amount of voltage drop with respect to the input voltage so that the output voltage stays at the desired voltage for the internal circuit. The voltage regulator circuit of the present invention is mainly comprised of CMOS inverters which consume very little power.

BEST MODE FOR CARRYING OUT THE INVENTION

Figure 1:
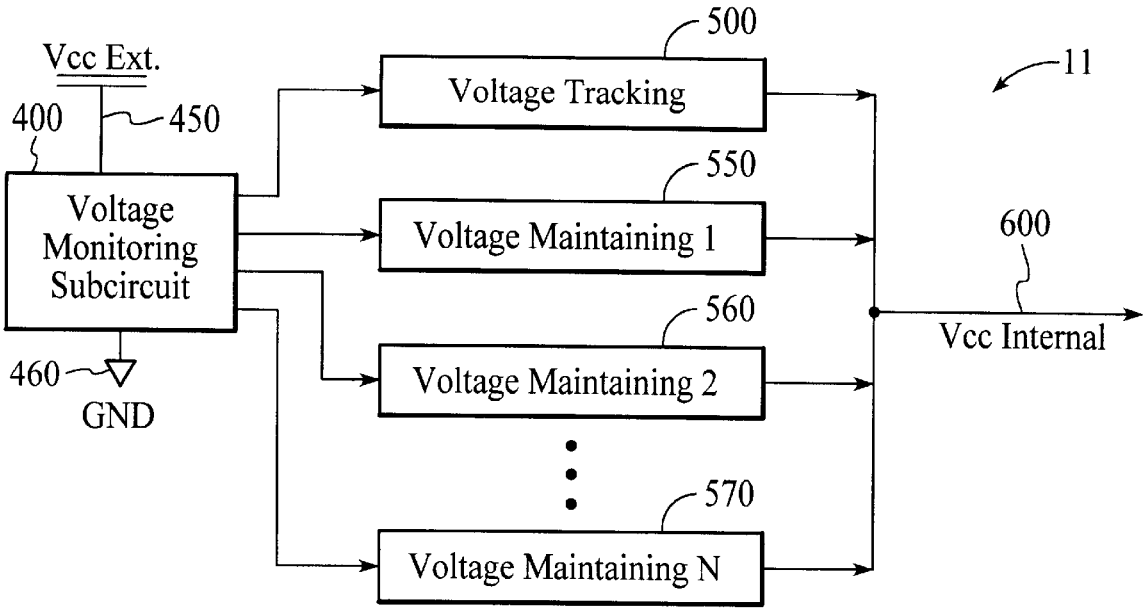
FIG. 1 is a schematic block diagram of the voltage regulator circuit of the present invention.

With reference to FIG. 1, the voltage regulator circuit of the present invention 11 includes a voltage monitoring circuit 400 which receives an external voltage, Vcc external 450, as the input to the circuit and is also connected to ground 460. The output of the voltage monitoring circuit 400 is supplied to a voltage tracking subcircuit 500 and to a plurality of voltage maintaining subcircuits 550, 560, 570. These subcircuits produce an output voltage at an output 600 which is a Vcc internal signal to an internal circuit of a device. As the Vcc external voltage 450 increases from zero volts to the desired voltage level for the output 600, the voltage tracking subcircuit 500 provides the voltage at output 600 at the same level as Vcc external 450. As Vcc external 450 increases to (1×|VT|) threshold above the desired output voltage, where |T| is the threshold voltage of the PMOS and NMOS transistors in the voltage regulator circuit 11, the voltage tracking subcircuit 500 turns off and the first voltage maintaining subcircuit 550 turns on, to maintain the output voltage at the desired voltage. As the Vcc external increases to (2×|VT|) above the desired voltage level, the first voltage maintaining subcircuit 550 turns off and the second voltage maintaining subcircuit 560 turns on to keep the output at the desired voltage level. Additional voltage maintaining subcircuits may be implemented to maintain the output voltage at the desired level through further increases in Vcc external. The voltage regulator circuit 11 continues to function as described above until the final voltage maintaining subcircuit 570 is utilized.

Figure 2:
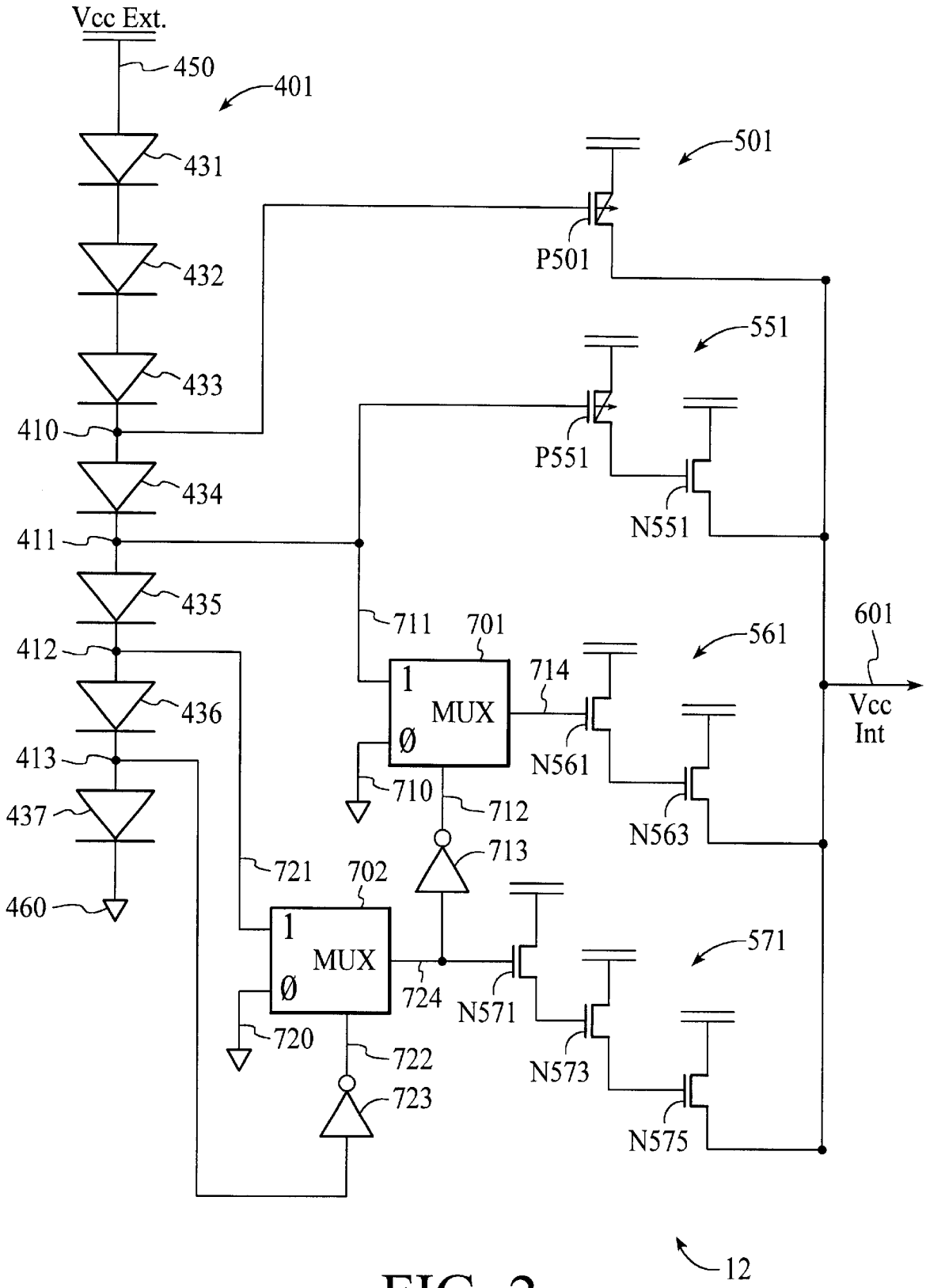
FIG. 2 is an electrical circuit diagram of a first embodiment of the voltage regulator circuit of FIG. 1.

With reference to FIG. 2, a first embodiment 12 of the present invention is shown. The voltage monitoring circuit 401 is comprised of a chain of diodes connected in series. Each of these diodes can be implemented by an NMOS transistor having its gate connected to its drain. These diodes operate as a voltage divider. Each diode in the voltage monitoring circuit 401 represents a voltage drop of one threshold voltage, or (1×|VT|). The first diode 431 in the chain of diodes has an input connected to the Vcc external voltage 450. The voltage tracking subcircuit 501 connects to the voltage monitoring circuit 401 at node 410, while the first voltage maintaining subcircuit 551 and the second voltage maintaining subcircuit 561 connect to the voltage monitoring subcircuit 401 at node 411. Subsequent voltage maintaining subcircuits connect at nodes further down the chain of diodes, such as at node 412 and node 413. The last diode 437 of the chain of diodes is connected to the ground potential 460.

The voltage tracking subcircuit 501 consists of a PMOS transistor P501 having a gate connected to a node 410 in the voltage monitoring circuit 401, a source connected to Vcc external, and a drain connected to the output 601. The first voltage maintaining circuit 551 consists of a PMOS transistor P551 having a gate connected to a second node 411 in the voltage monitoring circuit 401, a source connected to Vcc external, and a drain connected to the gate of an NMOS transistor N551. Transistor N551 has a drain connected to Vcc external and a source connected to the output 601. The second voltage maintaining circuit 561 consists of a multiplexer 701 having a high input 711 connected to the second node 411 of the voltage monitoring circuit 401, a low input connected to the ground potential, a clock input 712, and an output 714 connected to the gate of an NMOS transistor N561. The NMOS transistor N561 has a drain connected to Vcc external and a source connected to the output 601. The third voltage maintaining circuit 571 consists of a multiplexer 702 having a high input 721 connected to a third node 412 of the voltage monitoring circuit 401, a low input 720 connected to the ground potential, a clock input 722 and an output 724. The output 724 of the multiplexer 702 is connected to an inverter 713 which provides an inverted clock signal at the clock input 712 of the multiplexer 701 of the prior voltage maintaining circuit 561. The output 724 of multiplexer 702 is also connected to the gate of an NMOS transistor N571, which has a drain connected to Vcc external and a source connected to the gate of a second NMOS transistor N573. Transistor N573 has a drain connected to Vcc external and a source connected to the gate of a third NMOS transistor N575. Transistor N575 has a drain connected to Vcc external and a source connected to the output 601. Subsequent voltage maintaining subcircuits may be added to the voltage regulator circuit. Each subsequent voltage maintaining circuit would be constructed in a similar manner to the third voltage maintaining subcircuit 571, except that an additional NMOS transistor would be added for each subsequent voltage maintaining subcircuit (i.e. the second subcircuit 561 has two NMOS transistors, the third subcircuit 571 has three NMOS transistors, a fourth subcircuit would have four NMOS transistors, etc . . . ).

For the purposes of explanation, assume that the output voltage at output 601 is desired to be maintained at 3 volts. Also, assume that the voltage threshold drop |VT| across each diode is 1 volt. When Vcc external 450 starts to increase from zero volts, the node 410 in the diode chain is at a low logic level. This low logic level turns on the PMOS transistor P501 in active mode, allowing the Vcc external applied to the source of PMOS transistor P501 to pass through to the output 601 of the circuit. When Vcc external 450 increases to the desired voltage level, in this case 3 volts, there is a (3×|VT|) voltage drop, corresponding to a (1×|VT|) voltage drop across each of the diodes 431, 432, and 433, such that the node 410 remains at a low logic level. As the input voltage, Vcc external, increases beyond the desired voltage level, node 410 transitions to a high logic level, which turns off PMOS transistor P501 which shuts off the voltage tracking subcircuit 501.

Initially, node 411 is also at a low logic level and this turns on PMOS transistor P551 of the first voltage monitoring circuit 551. However, when the output voltage is less than the desired voltage level, NMOS transistor N551 is off because the voltage level at the gate of transistor N551, Vcc external through transistor P551, is equal to the voltage level at the source of N551, since Vcc external is equal to Vcc internal. Therefore, there is no voltage threshold |VT| difference across transistor N551, which would be necessary in order to turn on transistor N551. After the voltage tracking subcircuit 501 is turned off, the voltage at the source of transistor N551 starts to fall as the output voltage Vcc internal at output 601 starts to decrease. When the voltage Vcc internal at output 601, and therefore the voltage at the source of transistor N551, reaches (1×|VT|) below the gate voltage of transistor N551, transistor N551 turns on. Thus, the first voltage maintaining subcircuit 551 is turned on and passes a voltage of (Vcc external−1|VT|) to the output 601 to maintain the output voltage at the desired voltage level until the external Vcc increases by another (1×|VT|) volts. After the external voltage increases by (1×|VT|) the node 411 transitions to a high logic level which turns off transistor P551 and thus shuts down the first voltage maintaining subcircuit 551.

Initially, when node 411 is at a low logic level, the second voltage maintaining subcircuit 561 is off. The low signal is passed first to a multiplexer 701 and since at this point the clock input 712 is at a high logic level, the high input 711 to the multiplexer proceeds to the output 714, which passes the low signal to the gate of transistor N561. This turns transistor N561 off. When the node 411 transitions to a high signal, the high signal passes through the multiplexer 701 to pass the high signal to NMOS transistor N561, turning N561 on. This turns on transistor N563 which passes the Vcc external signal, a voltage of (Vcc external−2|VT|) to the output 601. Since, at this point, the external voltage is (2×|VT|) above the desired output level, the (1×|VT|) voltage drops across each of transistors N561 and N563 maintain the output voltage at the desired level.

After the Vcc external reaches a voltage higher than (Vcc external+2|VT|), node 412 transitions from low to high. Initially, node 412 is low and the low signal proceeds through multiplexer 702 to provide a low signal at the multiplexer output 724. This causes transistor N571 to be turned off, which results in the next voltage maintaining subcircuit 571 being off. The low signal at 724 goes to an inverting amplifier to provide a high signal at the clock input 712 of multiplexer 701 which lets the high signal at input 711 pass through the multiplexer to the gate of transistor N561 to turn on the second voltage maintaining subcircuit 561 as described above. When node 412 becomes high, the high signal proceeds through multiplexer 702 and is supplied to inverting amplifier 713 which provides a low signal to the clock input 712 of multiplexer 701, which turns off multiplexer 701 and shuts down the subcircuit 561. The high signal also passes through multiplexer 702 to turn on the next voltage maintaining subcircuit 571 as inverter N571 turns on. This turns on the subsequent NMOS transistors N573 and N575 which provides a voltage of (Vcc external−3|VT|) to the output 601. Again, as subcircuit 561 turns off, the subcircuit 571 turns on, as the voltage drop at the source of transistor N575 turns on transistors N575, N573, and N571 to provide the desired voltage at output 601. The circuitry can be expanded to cover the case for further increases in Vcc external. A further rise in Vcc external would put node 413 in a high state and the high signal would pass through inverter 723 to turn off the clock input 722 to the multiplexer 702, which would cause subcircuit 571 to turn off and a subsequent subcircuit would then turn on.

Each subsequent voltage maintaining subcircuit has an additional NMOS transistor in order to account for the number of |VT| drops necessary to compensate for the increasing Vcc external signal and to provide a constant voltage on the output 601. For example, the first voltage maintaining subcircuit 551 operates when Vcc external is between the desired value and (the desired value+1|VT|). Therefore, only 1 NMOS transistor N551 is necessary in the circuit to compensate for the (1×|VT|) volt difference between Vcc external and the desired voltage. To illustrate, assuming that the desired voltage level is 3 volts, at the point when node 411 has just turned on transistor P551, the Vcc external would be 4 volts, which would be applied to transistor N551. Therefore, a |1×Vt| voltage drop through transistor N551 would be required in order to reduce the voltage from 4 volts to the desired level of 3 volts at the output 601. Subsequently, at the time when voltage maintaining subcircuit 561 is operating, the Vcc external would be at [the desired voltage+(2×|VT|)], thus requiring 2 NMOS transistors N561 and N563 in the voltage maintaining subcircuit 561 in order to drop the voltage by 2 |VT| down to the desired voltage at the output 601. Subsequent subcircuits will require one additional NMOS transistor for each additional |VT| increase in the Vcc external.

Figure 4:
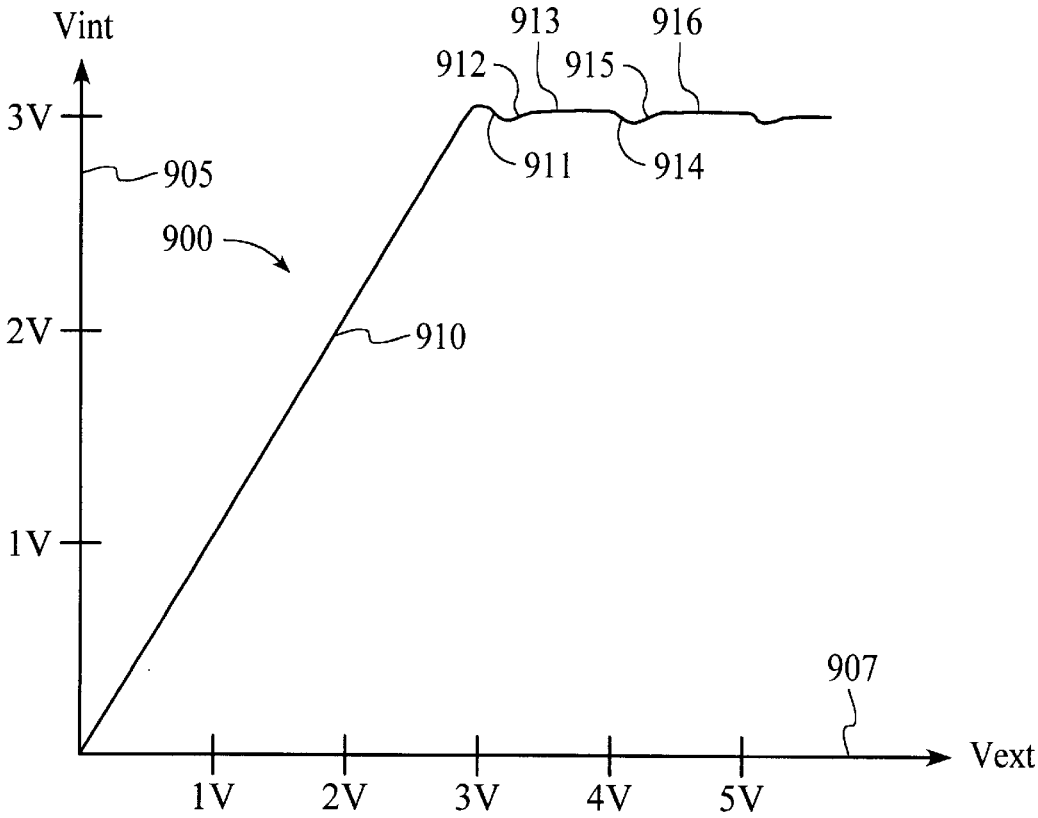
FIG. 4 is a graph of the external voltage Vcc (input) vs. the Vcc internal signal (output) of the voltage regulator circuit of FIG. 1.

With reference to FIG. 4, the graph 900 of the circuit input voltage, Vcc external 907 vs. the circuit output voltage, Vcc internal 905 demonstrates how the plurality of voltage maintaining subcircuits operate within the voltage regulating circuit. In the graph, 900, a portion 910 of the graph represents the period when the voltage tracking subcircuit 501 is operating. As can be seen from this portion 910 of the graph, the output voltage 905 tracks the input voltage 907 on a corresponding one-to-one basis. When the input voltage 907 reaches 3 volts, which is, in this example, the desired level of the output voltage, the voltage tracking subcircuit 501 turns off, which cause a slight decrease 911 in the output voltage. Then, when the first voltage maintaining subcircuit 551 turns on, the graph shows an increase 912 in the voltage back up to 3 volts, the level that is desired. In portion 913 of the graph, the output voltage stays constant at 3 volts while the input voltage continues to increase. When the input voltage reaches the next threshold level, the first voltage maintaining subcircuit turns off, shown in the slight decrease in the output voltage at portion 914, and the second voltage maintaining subcircuit turns on, as noted by the increase 915 in voltage back to the desired level. Then the output is constant at portion 916 at the desired voltage level until the next threshold level is reached. Thus, the output voltage is regulated to the desired voltage level of 3 volts even while the input voltage increases beyond that level.

Figure 3:
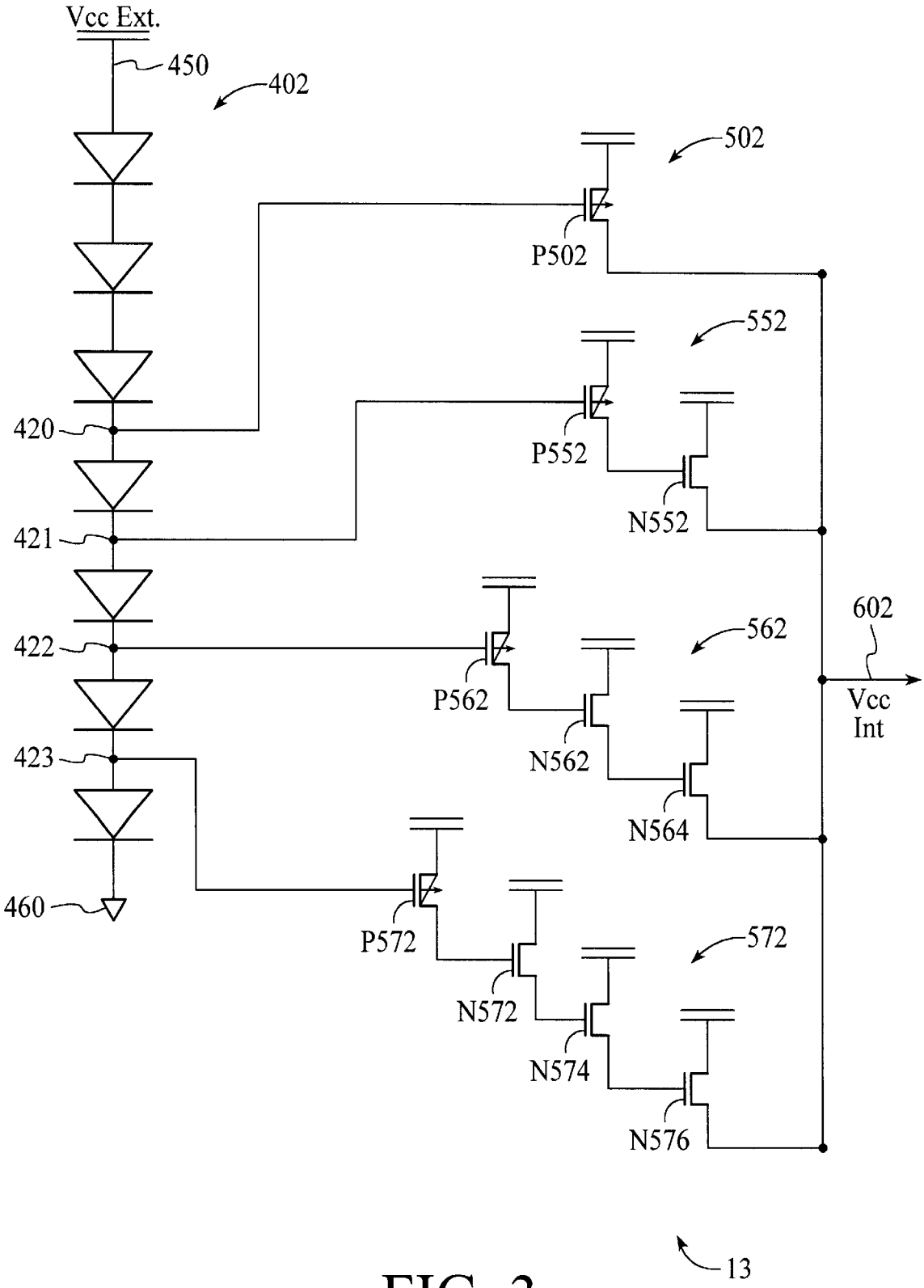
FIG. 3 is an electrical circuit diagram of a second embodiment of the voltage regulator circuit of FIG. 1.

FIG. 3 shows an alternate embodiment to the circuit shown in FIG. 2. The difference between the circuits of FIG. 2 and FIG. 3 is that in the embodiment of FIG. 3, each of the multiplexer circuits have been replaced by a PMOS transistor. Thus, the voltage tracking subcircuit 502 and the first voltage maintaining subcircuit 552 are constructed and operate in the same manner as described above in reference to the circuit of FIG. 2. The second voltage maintaining subcircuit 562 consists of a PMOS transistor P562 having a gate connected to a node 422 of the voltage monitoring circuit 402, a source connected to Vcc external and a drain connected to the gate of an NMOS transistor N562. The transistor N562 has a drain connected to Vcc external and a source connected to a second NMOS transistor N564. Transistor N564 has a drain connected to Vcc external and a source connected to the output 602. The third voltage maintaining subcircuit 572 consists of a PMOS transistor P572 having a gate connected to a second node 423 of the voltage monitoring circuit 401, a source connected to Vcc external and a drain connected to the gate of an NMOS transistor N572. NMOS transistor N572 and subsequent NMOS transistors N574 and N576 are connected in the same manner as described with reference to transistors N571, N573 and N575 of FIG. 2.

The following describes the operation of the second and third voltage maintaining subcircuits 562 and 572. Since nodes 422 and 423 are initially at a low logic level, the PMOS transistors P562 and P572 are initially on. However, since the difference between the input voltage, Vcc external, and the output voltage, Vcc internal, is the same at the time when Vcc external initially increases from zero volts, there is no voltage threshold difference across the NMOS transistors and, thus, the NMOS transistors N562 and N564 of subcircuit 562 and NMOS transistors N572, N574 and N576 of subcircuit 572 are all off. When the Vcc external reaches the desired output level, node 420 becomes high, which turns off transistor P502 and the voltage tracking subcircuit 502. Node 421 is still at a low level so PMOS transistor P552 remains on, passing the increasing Vcc external to the gate of transistor N552. As the input voltage Vcc external increases above the desired output voltage, the voltage at the source of transistor N552 becomes lower than the voltage of the gate of transistor N552. This voltage drop across transistor N552 turns transistor N552 on and this turns on subcircuit 552 in order to provide the steady output voltage at the circuit output 602. Again, since transistor N552 provides a $(1\times|VT|)$ voltage drop from Vcc external, the output voltage remains at the desired voltage level. When the Vcc external increases by $(1\times|VT|)$ volts, node 421 reaches a high logic level which turns off transistors P552 and N552. The Vcc external continues to rise, and when the Vcc external is $(2\times|VT|)$ volts above the output voltage, transistors N564 and N562 are on and provide a $(2\times|VT|)$ voltage drop from Vcc external in order to maintain the output voltage at the desired voltage level. This process continues as described above through subsequent voltage maintaining subcircuits, such as subcircuit 572.

Figure 5:
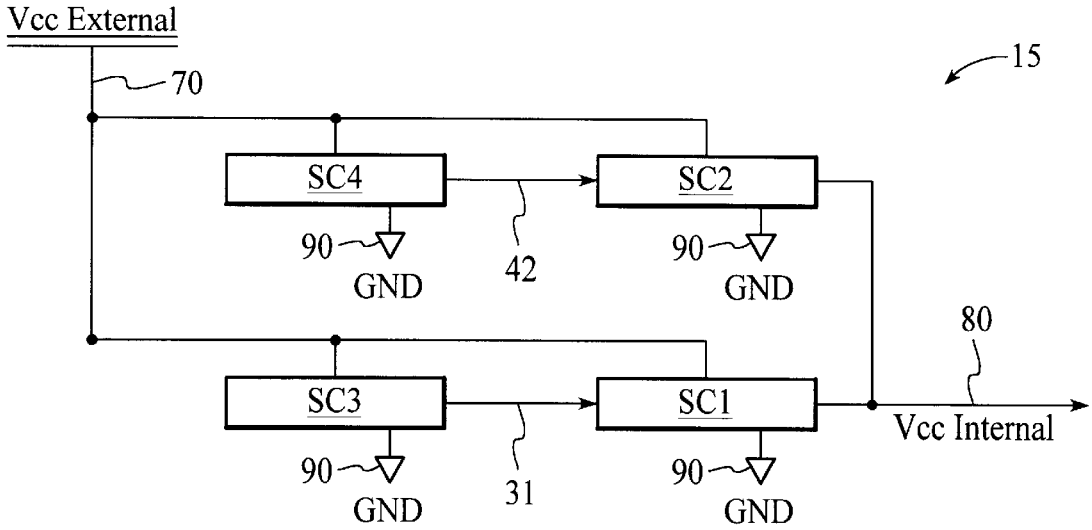
FIG. 5 is a schematic block diagram of the preferred embodiment of the voltage regulator circuit of the present invention.
Figure 7:
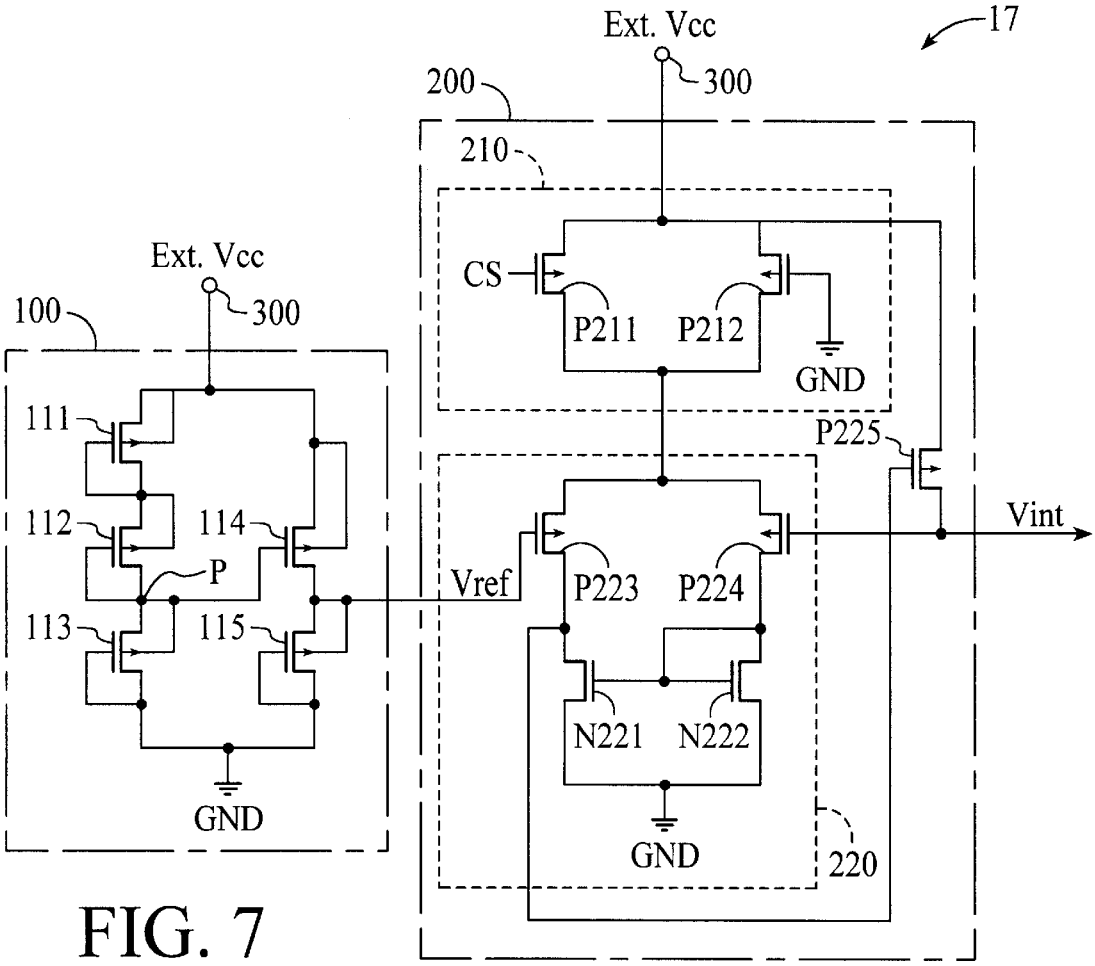
FIG. 7 (PRIOR ART)
FIG. 7 is a circuit diagram illustrating a conventional internal stepdown circuit as known in the prior art.

FIG. 5 shows a schematic block diagram illustrating the subcircuit structures of the preferred embodiment of the voltage regulator circuit of the present invention. The voltage regulator circuit 15 includes a voltage tracking subcircuit SC1, a voltage maintaining subcircuit SC2, and a pair of voltage monitoring subcircuits SC3, SC4. The voltage monitoring subcircuits could be combined into one subcircuit, as in the previous embodiments, but in this case one voltage monitoring subcircuit SC3 corresponds to the voltage tracking circuit SC1 and the other voltage monitoring circuit SC4 corresponds to the voltage maintaining circuit SC2 in order to provide a separate timing delay to their respective subcircuit. Each subcircuit has connections to a Vcc external 70 and a ground (GND) 90. Subcircuit SC1 also receives an input 31 from subcircuit SC3 and provides a Vcc internal signal 80 to an internal circuit. Subcircuit SC2 also receives an input 42 from subcircuit SC4 and also provides an output to Vcc internal.

Figure 6:
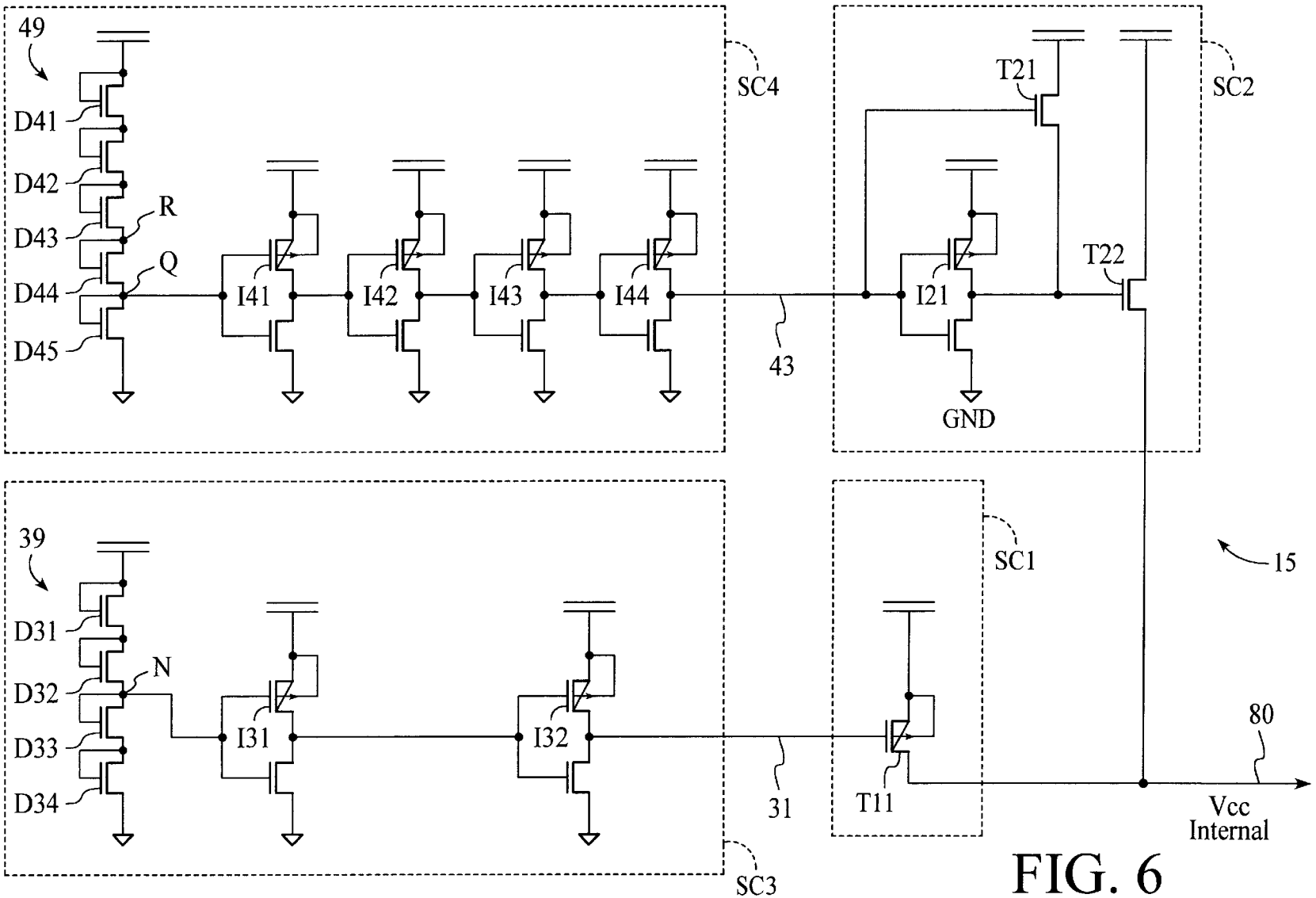
FIG. 6 is an electrical circuit diagram of the voltage regulator circuit of FIG. 5.

With reference to FIG. 6, subcircuit SC1 is comprised of a PMOS transistor Tll having a gate connected to an inverter I32 at input 31. The source of transistor T11 connects to Vcc external and the drain of T11 connects to Vcc internal. Transistor T11 helps Vcc internal to track Vcc external, with no voltage drop, when Vcc external increases from zero volt up to a desired voltage.

Subcircuit SC2 is comprised of an inverter I21, and NMOS two transistors T21 and T22. Inverter I21 connects to Vcc external and GND and also receives an input 43 from subcircuit SC4. Transistor T21 has a gate connected to input 43, a drain connected to Vcc external, and a source connected to the output of inverter I21. Transistor T22 has a gate connected to the output of inverter I21, a source connected to Vcc external and a drain connected to Vcc internal.

Subcircuit SC3 is comprised of a chain of diodes 39 D31, D32, D33, and D34 connected in series. Each of these diodes consists of an NMOS transistor having a gate connected to a drain. These diodes work as a voltage divider. There is a node N within the diode chain. Node N connects to two inverters in series: I31 and I32. The output of inverter I32 connects to the gate of transistor T11 of subcircuit SC1 through input 31.

Subcircuit SC4 is comprised of a chain of diodes 49 in series D41, D42, D43, D44 and D45. Each of these diodes consists of an NMOS transistor having a gate connected to a drain. There is a node Q in the diode chain. Node Q connects to a chain of four inverters in series: I41, I42, I43 and I44. The output of inverter I44 connects to the input of inverter I21 of subcircuit SC2.

The voltage regulator circuit 15 of the present invention, described above, works as follows. When Vcc external increases from zero volts to V1, transistor T11 helps Vcc internal to track Vcc external with no voltage drop. When Vcc external starts rising from zero volts, the voltage at the drain of transistor T11 follows Vcc external. However, the voltage at the gate of transistor T11 remains at zero. This makes PMOS transistor T11 stay on. The input of inverter I32 also remains at zero volts at least for a while. Vcc internal connects to the drain of transistor T11; therefore, Vcc internal tracks Vcc external which connects to the source of transistor T11.

Because diode chain 39 of subcircuit SC3 works as a voltage divider, the voltage at node N (called Vn) in diode chain 39 also rises when Vcc external rises. However, Vn is proportionally smaller than Vcc external. The diodes in diode chain 39 are designed such that when VCC external and Vcc internal rise above the desired voltage V1, Vn reaches a voltage high enough to be a logic 1 input to inverter I31. Then, the output of inverter I31 becomes a logic 0, which in turn causes the output of inverter I32 to change from logic 0 to logic 1. This turns off transistor T11 and Vcc internal no longer follows Vcc external and starts to fall. However, at this time, subcircuit SC2 takes control and helps Vcc internal to remain at two times Vtn below Vcc external (where Vtn is the threshold voltage of transistors T21 and T22), even if Vcc external continues to rise to a second voltage V2.

Just before transistor T11 of subcircuit SC1 is turned off, assume that input 43 has changed from a logic 0 to a logic 1 (subcircuit SC4 can be designed to cause this change). This would mean that transistors T21 and T22 are on. Because the gate of transistor T22 connects to the drain of transistor T21, Vcc internal is clamped to two times Vtn below Vcc external. Transistors T21 and T22 are designed such that $2\times Vtn=V2-V1$.

The function of subcircuit SC4 is similar to that of subcircuit SC3. Subcircuit SC4 is designed such that just before transistor T11 of SC1 is turned off, node Q reaches a voltage high enough to change the input to inverter I41 to a logic 1. Then, the reaction propagates along chain of inverters I41–I44 causing the voltage at input 43 to become high. This turns on transistors T21 and T22 of subcircuit SC2 and makes them ready to clamp Vcc internal. The chain of inverters I41–I44 in subcircuit SC4 and I31-32 in subcircuit SC3 operate as a delay circuit to provide the desired timing to the voltage regulator circuit 15.

A circuit block can be added to the embodiment in FIG. 6 so that if Vcc external rises to a voltage V3 which is four times Vtn above V1, Vcc internal is clamped to four times Vtn below Vcc external (i.e. V1). For example, another block comprising a chain of four inverters and a subblock like subcircuit SC2 can be connected to a node R in diode chain 49. The diodes in diode chain 49 are designed such that only when Vcc external rises to four times Vtn above V1, node R reaches a voltage high enough to change the input of the first inverter in the inverter chain (in added circuit component) to a logic 1. Then, the entire added block will function to clamp Vcc internal to four times Vtn below Vcc external.

Because the voltage regulator circuit of the present invention uses mostly CMOS transistors, power consumption is reduced significantly compared to prior art. In the preferred embodiment of the invention, the voltage regulator circuit only burns approximately 0.5 $\mu$A of the supply current, which is much lower than the circuits of the prior art.

What is claimed is:

1. A voltage regulator circuit comprising:

an input node receiving an input voltage and an output node producing an output voltage, a voltage tracking subcircuit having an input connected to the input node, a second input and an output connected to the output node, a plurality of voltage maintaining subcircuits, each voltage maintaining circuit having a first input connected to the input node, a second input and an output connected to the output node, and a voltage monitoring subcircuit having an input connected to the input node and a plurality of outputs, a first output of said plurality of outputs being connected to the second input of the voltage tracking subcircuit, each of a remaining number of the plurality of outputs being connected to a corresponding one of the plurality of voltage maintaining subcircuits.

2. The voltage regulator circuit of claim 1 wherein the voltage monitoring subcircuit enables the voltage tracking subcircuit when the input voltage is increased from zero volts to a desired voltage, the voltage tracking subcircuit maintaining the output voltage at a same level as the input voltage until the input voltage reaches the desired voltage.

3. The voltage regulator circuit of claim 1 wherein the voltage monitoring subcircuit disables the voltage tracking subcircuit and enables one of the plurality of voltage maintaining subcircuits when the input voltage is increased above the desired voltage, each of the voltage maintaining subcircuits maintaining the output voltage at the desired voltage.

4. The voltage regulator circuit of claim 1 wherein the voltage tracking subcircuit includes a transistor having a control gate, a drain, and a source wherein the control gate connects to the second input of the voltage tracking subcircuit and connects to the first output of the voltage monitoring subcircuit, one of said source and said drain being connected to the input node and the other being connected to the output node.

5. The voltage regulator circuit of claim 4 wherein the first transistor is a PMOS, said drain connecting to the output node and said source connecting to the input node.

6. The voltage regulator circuit of claim 1 wherein one of the plurality of voltage maintaining subcircuits includes:

a first transistor having a drain, a source, and a gate, one of said drain and said source of the first transistor connecting to the input node and the other connecting to the output node, and a second transistor having a drain, a source, and a gate, one of said drain and said source of the second transistor connecting to the input node and the other connecting to the gate of the first transistor, and said gate of the second transistor connecting to the output of the voltage monitoring subcircuit.

7. The voltage regulator circuit of claim 6 wherein the second transistor is a PMOS, said source of the second transistor connecting to the input node and said drain of the second transistor connecting said gate of the first transistor and, wherein the first transistor is an NMOS, said drain of the first transistor connecting to the input node and said source of the first transistor connecting to the output node.

8. The voltage regulator circuit of claim 1 wherein one of the plurality of voltage maintaining subcircuits includes:

a first transistor having a drain, a source, and a gate, one of said drain and said source of the first transistor connecting to the input node and the other one of said drain and said source connecting to the output node, a second transistor having a drain, a source, and a gate, one of said drain and said source of the first transistor being connected to the input node and the other one of said drain and said source being connected to the gate of the first transistor, and a third transistor having a drain, a source, and a gate, one of said drain and said source of the second transistor connecting to the input node and the other one of said drain and said source connecting to the gate of the second transistor, and said gate of the second transistor connecting to one of the plurality of outputs of the voltage monitoring subcircuit.

9. The voltage regulator circuit of claim 8 wherein the third transistor is an PMOS, said source of the third transistor connecting to the input node and said drain of the third transistor connecting said gate of the second transistor, wherein the second transistor is an NMOS, said drain of the second transistor connecting to the input node and said source of the second transistor connecting to the gate of the first transistor, and wherein the first transistor is an NMOS, said drain of the first transistor connecting to the input node and said source of the first transistor connecting to the output node.

10. The voltage regulator circuit of claim 8 further including a fourth transistor having a drain, a source, and a gate, and being connected between the first transistor and the output node, one of said drain and said source of the fourth transistor connecting to the input node and the other one of said drain and said source of the fourth transistor connecting to the output node, and the gate being connected to the other one of said drain and said source of the first transistor.

11. The voltage regulator circuit of claim 8 further including a plurality of transistors connected between the first transistor and the output node, each of the plurality of transistors having a drain, a source and a gate, each of the plurality of transistors having one of said drain and said source connected to the input node and the other one of said drain and said source connected to the gate of a subsequent transistor, with the gate of a first of the plurality of transistors being connected to the other one of said drain and said source of the first transistor and one of said drain and said source of a last of the plurality of transistors being connected to the output node.

12. The voltage regulator circuit of claim 1, wherein one of the plurality of voltage maintaining subcircuits includes:

first transistor having a drain, a source, and a gate, one of said drain and said source of the first transistor being connected to the input node and the other one of said drain and said source being connected to the output node, a second transistor having a drain, a source and a gate, one of said drain and said source of the second transistor being connected to the input node and the other one of said drain and said source being connected to te gate of the first transistor, and a multiplexer circuit having a first input, a second input, a clock input and an output, said output being connected to the gate of the second transistor, said first input being connected to one of the plurality of outputs of the voltage monitoring subcircuits, and said second input being connected to a ground potential.

13. The voltage regulator circuit of claim 12 wherein each of the plurality of voltage maintaining subcircuits further includes a plurality of transistors connected between the first transistor and the output node, each of the plurality of transistors having a drain, a source and a gate, each of the plurality of transistors having one of said drain and said source connected to the input node and the other connected to the gate of a subsequent transistor, with the gate of a first of the plurality of transistors being connected to the other one of said drain and said source of the first transistor and one of said drain and said source of a last of the plurality of transistors being connected to the output node.

14. The voltage regulator circuit of claim 1 wherein the voltage monitoring subcircuit includes a voltage divider circuit having an input and an output, said input of the voltage divider circuit connecting to the input node.

15. The voltage regulator circuit of claim 14 wherein the voltage divider circuit further comprises a chain of diodes in series, a first diode in the chain of diodes having an input connected to said input of the voltage divider circuit, a first node in the chain of diodes connecting to said output of the voltage divider circuit.

16. The voltage regulator circuit of claim 15 wherein each diode is implemented by an NMOS transistor having a gate, a source and a drain, the gate and the drain being connected.

17. The voltage regulator of claim 14, wherein the voltage monitoring subcircuit includes a delay circuit having an input and an output, said input of the delay circuit connecting to said output of the voltage divider circuit.

18. The voltage regulator circuit of claim 17 wherein the delay circuit further comprises a chain of inverters in series, a first inverter in the chain of inverters having an input connecting to said output of the voltage divider circuit, a last inverter in the chain of inverters having an output connecting to said input of one of said voltage tracking subcircuit and said voltage maintaining subcircuits.

19. A voltage regulator circuit comprising:

an input node receiving an input voltage and an output node producing an output voltage, a voltage tracking subcircuit having a first input connected to the input node, a second input, and an output connected to the output node, a voltage maintaining subcircuit having a first input connected to the input node, a second input, and an output connected to the output node, a first voltage monitoring subcircuit having an input connected to the input node and an output connected to the second input of the voltage tracking subcircuit and a second voltage monitoring subcircuit having an input connected to the input node and an output connected to the second input of the voltage maintaining subcircuit, wherein the first voltage monitoring subcircuit enables the voltage tracking subcircuit when the input voltage is increased from zero volts to a desired voltage, the voltage tracking subcircuit maintaining the output voltage at a same level as the input voltage until the input voltage reaches the desired voltage, and wherein the first voltage monitoring subcircuit disables the voltage tracking subcircuit and the second voltage monitoring subcircuit enables the voltage maintaining subcircuit when the input voltage is increased above the desired voltage, the voltage maintaining circuit maintaining the output voltage at the desired voltage.

20. The voltage regulator circuit of claim 19 wherein the voltage tracking subcircuit includes a transistor having a control gate, a drain, and a source wherein said control gate connects to said second input of the voltage tracking subcircuit and connects to said output of the first voltage monitoring subcircuit, one of said source and said drain being connected to the input node and the other being connected to the output node.

21. The voltage regulator circuit of claim 20 wherein the first transistor is a PMOS, said drain connecting to the output node, said source connecting to the input node.

22. The voltage regulator circuit of claim 19 wherein the voltage maintaining subcircuit includes:

a first transistor having a drain, a source, and a gate, one of said drain and said source of the first transistor connecting to the input node and the other connecting to the output node, a first inverter having an input and an output, said input of the first inverter connecting to said second input of the voltage maintaining subcircuit, and said output of the first inverter connecting to said gate of the first transistor, a second transistor having a drain, a source, and a gate, one of said drain and said source of the second transistor connecting to the input node and the other one of said drain and said source connecting to the output node, and said gate of the second transistor connecting to said second input of the voltage maintaining subcircuit.

23. The voltage regulator circuit of claim 22 wherein the second transistor is an NMOS, said drain of the second transistor connecting to the input node and said source of the second transistor connecting said gate of the first transistor and, wherein the first transistor is an NMOS, said drain of the first transistor connecting to the input node and said source of the first transistor connecting to the output node.

24. The voltage regulator circuit of claim 19 wherein each of the first and second voltage monitoring subcircuits includes:

a voltage divider circuit having an input and an output, said input of the voltage divider circuit connecting to the input node, a delay circuit having an input and an output, said input of the delay circuit connecting to said output of the voltage divider circuit.

25. The voltage regulator circuit of claim 24 wherein the voltage divider circuit further comprises a chain of diodes in series, a first diode in the chain of diodes having an input that connects to said input of the voltage divider circuit, a node in the chain of diodes connecting to said output of the voltage divider circuit.

26. The voltage regulator circuit of claim 25 wherein the delay circuit further comprises a chain of inverters in series, a first inverter in the chain of inverters having an input connecting to said output of the voltage divider circuit, a last inverter in the chain of inverters having an output connecting to said input of one of said voltage tracking subcircuit and said voltage maintaining subcircuits.

27. The voltage regulator circuit of claim 26 wherein said input of the chain of inverters in the first voltage monitoring subcircuit reaches a threshold voltage of said first inverter in the chain of inverters to trigger the operation of the chain of inverters to disable the voltage tracking subcircuit when the voltage on the input node increases above the desired voltage.

28. The voltage regulator circuit of claim 26 wherein the input of the chain of inverters in the second voltage monitoring subcircuit reaches a threshold voltage of said first inverter in the chain of inverters in the second voltage monitoring subcircuit to trigger the operation of the chain of inverters to enable the voltage maintaining subcircuit when the input voltage increases above the desired voltage.

* * * * *